US007048469B1

(12) United States Patent
Jansson

(10) Patent No.: US 7,048,469 B1
(45) Date of Patent: May 23, 2006

(54) FLEXIBLE GRID AND PREDOMINANTLY CONCRETE MAT EMPLOYING SAME

(76) Inventor: Jan Erik Jansson, 7974 Etrada de Luz East, Santaluz, CA (US) 92127

( * ) Notice: Subject to any disclaimer, the term of this patent is extended or adjusted under 35 U.S.C. 154(b) by 0 days.

(21) Appl. No.: 11/038,809

(22) Filed: Jan. 19, 2005

(51) Int. Cl.
*E02B 3/14* (2006.01)
*E02D 17/20* (2006.01)

(52) U.S. Cl. ..... 405/20; 405/15; 405/16; 405/302.7; 404/35; 52/602

(58) Field of Classification Search ..... 405/15–20, 405/302.6, 302.7; 404/29, 34, 35; 52/98, 52/602, 603
See application file for complete search history.

(56) References Cited

U.S. PATENT DOCUMENTS

| | | | | |
|---|---|---|---|---|
| 4,375,928 | A * | 3/1983 | Crow et al. | 405/20 |
| 5,108,222 | A | 4/1992 | Jansson et al. | |
| 5,358,356 | A * | 10/1994 | Romanek et al. | 405/16 |
| 5,632,571 | A * | 5/1997 | Mattox | 405/20 |
| 6,508,607 | B1 * | 1/2003 | Smith et al. | 405/20 |
| 6,585,449 | B1 * | 7/2003 | Chen | 404/36 |
| 6,612,776 | B1 | 9/2003 | Jansson | |
| 6,855,650 | B1 * | 2/2005 | Bohannon, Jr. | 405/15 |
| 2002/0069605 | A1 * | 6/2002 | Hong | 52/660 |

FOREIGN PATENT DOCUMENTS

| | | | | |
|---|---|---|---|---|
| GB | 2167795 | * | 6/1986 | |
| JP | 02047428 | * | 2/1990 | 405/17 |

* cited by examiner

*Primary Examiner*—Jong-Suk (James) Lee
(74) *Attorney, Agent, or Firm*—Wood, Phillips, Katz, Clark & Mortimer

(57) ABSTRACT

A flexible, molded, polymeric grid is embedded in a predominantly concrete mat comprising a concrete slab having relatively thicker portions defining blocks connected by relatively thinner portions, along which the concrete slab is breakable. The flexible grid has two longitudinal edges, two transverse edges, longitudinally extending members, and transversely extending members, where the longitudinally and transversely extending members connect the blocks to one another when the concrete slab is broken along the relatively thinner portions. The longitudinally and transversely extending members meet at nodes, which are spaced uniformly from one another, both longitudinally and transversely, except that, along the longitudinal and transverse edges, each node is spaced more distantly from the nodes nearest to the node. When the longitudinal and transverse members are disposed in an imaginary plane and the flexible grid is not stressed, fingers, which are unitary with the grid, extend from the imaginary plane.

12 Claims, 2 Drawing Sheets

FLEXIBLE GRID AND PREDOMINANTLY CONCRETE MAT EMPLOYING SAME

TECHNICAL FIELD OF THE INVENTION

This invention pertains to a flexible grid, which is useful to connect concrete blocks of a predominantly concrete mat, and to a predominantly concrete mat employing such a flexible geogrid.

BACKGROUND OF THE INVENTION

In an earlier form, an articulated, predominantly concrete mat is disclosed in U.S. Pat. No. 5,108,222, the disclosure of which is incorporated by reference herein. In an improved form, an articulated, predominantly concrete mat is disclosed in U.S. Pat. No. 6,612,776 B1, the disclosure of which is incorporated by reference herein. As disclosed in these patents, such a mat has numerous uses in retarding earth erosion due to wind, water, or both and in lining a driveway, a parking area, or an emergency roadway.

U.S. Pat. No. 6,612,776 B1 discloses that the articulated, predominantly concrete mat comprises concrete blocks, which are connected to one another by flexible members of a flexible geogrid. As disclosed therein, the articulated, predominantly concrete mat is made from a concrete slab, in which the flexible geogrid is embedded. As disclosed therein, the concrete slab has relatively thicker portions, which define such blocks, and relatively thinner portions, along which the concrete slab is broken to form such blocks and which has holes to facilitate breaking of the concrete slab. As disclosed therein, the flexible members of the flexible geogrid are flexible straps, as disclosed in U.S. Pat. No. 5,108,222, or are flexible strands or strand bundles.

Typically, an articulated, predominantly concrete mat, as discussed above, is sized to cover a ground area very many times smaller than a flexible geogrid, as available commercially, is able to cover. Thus, before being employed in an articulated, predominantly concrete mat, as discussed above, the flexible geogrid must be first cut to a smaller size. In a flexible geogrid, as available commercially, if spacings between the flexible members are imprecise in a longitudinal direction, in a lateral direction, or in both directions, it is difficult to employ the flexible geogrid in an articulated, predominantly concrete mat, as discussed above.

Moreover, in an articulated, predominantly concrete mat, the flexible members of the flexible geogrid reinforce the concrete blocks, except that the concrete blocks along the longitudinal and lateral edges of the articulated predominantly concrete mat may not be sufficiently reinforced by the flexible members of the flexible geogrid to prevent outer corners of the concrete blocks from cracking or breaking.

Furthermore, when a flexible geogrid, as available commercially, is embedded in a concrete slab, which is cast from a concrete slurry, the flexible geogrid tends to float upwardly in the concrete slurry, before the concrete mat has cured.

For any one or more of the foregoing reasons, a flexible geogrid, as available commercially, may prove to present shortcomings disfavoring its use in an articulated, predominantly concrete mat, as discussed above.

SUMMARY OF THE INVENTION

This invention provides a flexible grid, which preferably is a flexible, molded, polymeric grid. The flexible grid has two longitudinal edges, two transverse edges, longitudinally extending members, and transversely extending members.

The longitudinally and transversely extending members meet at nodes, which are spaced precisely and uniformly from one another, both longitudinally and transversely, except that, along the longitudinal and transverse edges, each node is spaced differently from the nodes nearest to said node.

Along the longitudinal and transverse edges, each node may be thus spaced more distantly from the nodes nearest to said node. Thus, the concrete blocks along the longitudinal and lateral edges of the articulated predominantly concrete mat may be less susceptible to cracking or breaking at outer corners.

In one contemplated embodiment, when the longitudinal and transverse members are disposed in an imaginary plane and the flexible grid is not stressed, fingers, which are unitary with the flexible grid, extend in directions intersecting the imaginary plane.

DETAILED DESCRIPTION OF THE ILLUSTRATED EMBODIMENT

Figure 1:
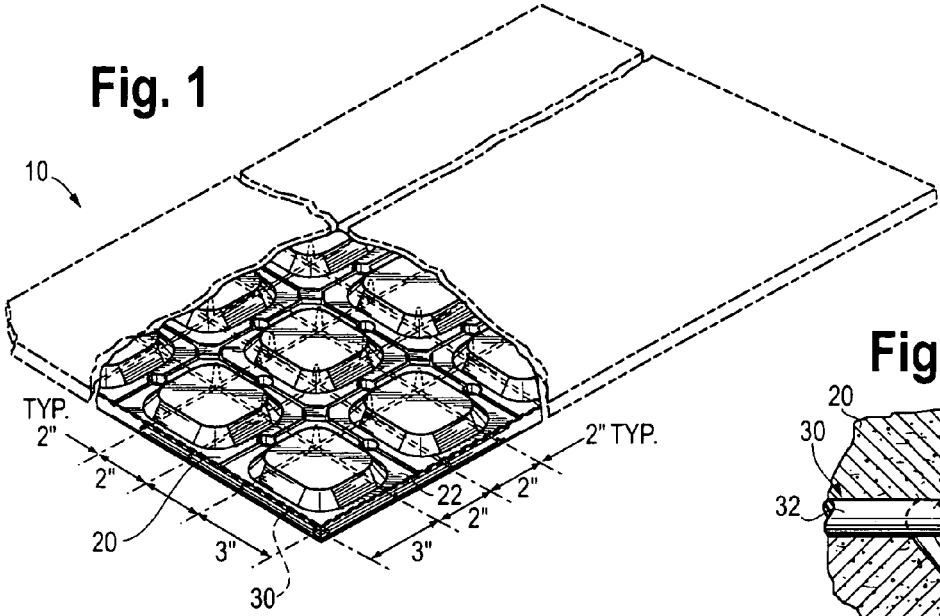
FIG. 1 is a fragmentary, isometric view of a concrete slab, in which a flexible grid embodying this invention and defining flexible members extending longitudinally and transversely is embedded.
Figure 3:
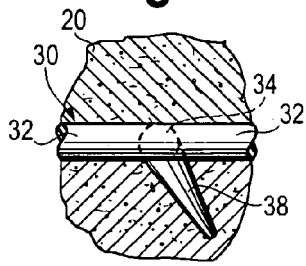
FIG. 3 is a greatly enlarged, sectional detail taken along line 3—3 of FIG. 4, in a direction indicated by arrows.

As illustrated in FIG. 1, an intermediate article 10 in the manufacture of an articulated, predominantly concrete mat, which is similar to the articulated, predominantly concrete mat disclosed in U.S. Pat. No. 6,612,776 B1, supra, comprises a rectangular, concrete slab 20 and a flexible grid 30, which is embedded in the concrete slab 20, so that flexible members 32 of the flexible grid 30 extend longitudinally and transversely when the concrete slab 20 is cast.

The concrete slab 20 is cast, in an inverted orientation relative to its illustrated orientation, so as to have relatively thinner portions 22 extending longitudinally and transversely and so as to have relatively thicker portions 24, which are separated from one another by the relatively thinner portions 22.

As illustrated in FIG. 7, the concrete slab 20 is breakable along the relatively thinner portions 22, so that the relatively thicker portions 24 become discrete, concrete blocks 40 connected to one another by flexible members 32 of the flexible grid 30, which remains embedded in the respective blocks 40, whereby an articulated, predominantly concrete mat 50 is provided. The flexible members 32 meet and are joined at nodes 34. Preferably, the flexible members 32 have circular cross-sections, but the flexible members 32 may have oval, rectangular, or other cross-sections.

So as to facilitate breaking of the concrete slab 20 along the relatively thinner portions 22, the concrete slab 20 has spaced holes, which include holes 26 having circular mouths and holes 28 having square mouths, along the relatively thinner portions 22. The relatively thinner portions 22 may be sufficiently thin to enable the concrete slab 20 to be thus broken by its own weight if and when the concrete slab 20 is lifted from its edges. Alternatively, the concrete slab 20 may be thus broken by a person wielding a suitable tool, such as an adze.

As exemplary dimensions, all of which are approximate, the concrete slab 20 may have a width of twenty-four inches and a length of forty-eight inches, the relatively thinner portions 22 may have a thickness of three-eights inch, the relatively thicker portions 24 may have a thickness of one inch, the flexible geogrid 30 may have two inch square openings, which are defined by the flexible members 32, except as illustrated and described herein, and the respective blocks 40 may be four inches square.

Figure 2:
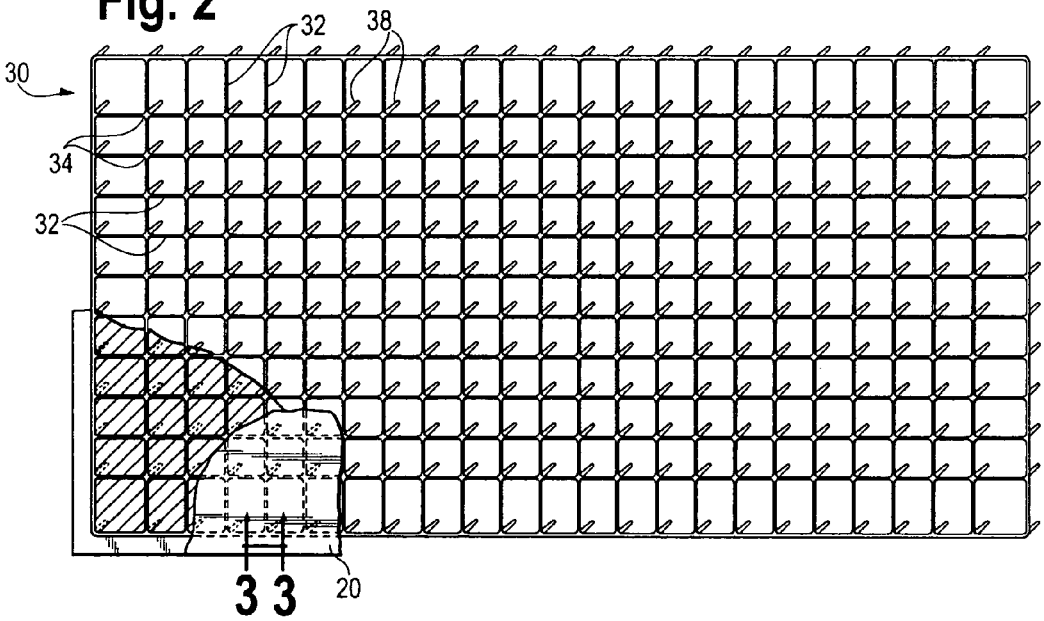
FIG. 2, on a smaller scale, is a fragmentary, schematic plan of an injection mold, in which the flexible grid illustrated in FIG. 1 is being molded.
Figure 4:
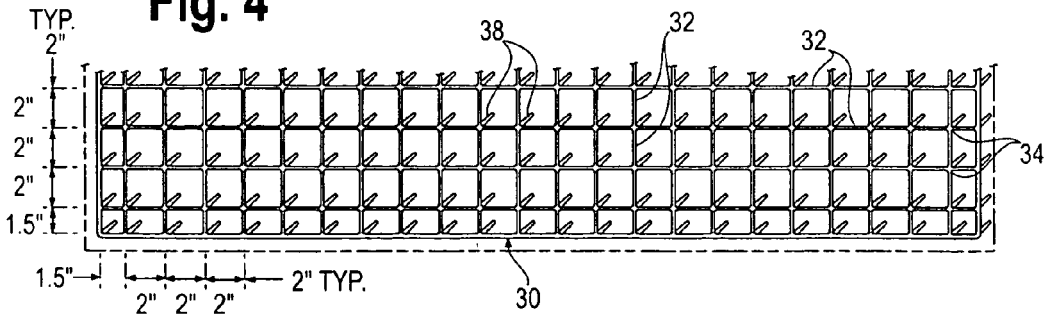
FIG. 4, on a similar scale, is a fragmentary plan of a corner portion of a flexible grid embodying this invention but conforming to an alternative construction.

The flexible grid 30 may be injection molded, as illustrated schematically in FIG. 2, so as to conform to a preferred construction, as illustrated in FIGS. 1, 2, and 7, or so as to conform to an alternative construction, as illustrated in FIG. 4. In the preferred construction, the nodes 34 of the flexible grid 30 are spaced precisely and uniformly (e.g. by two inches) from one another, both longitudinally and transversely, except that, along the longitudinal and transverse edges of the flexible grid 30, each node 32 is spaced more distantly (e.g. by three inches) from the nodes 32 nearest to said node 32. In the alternative construction, the nodes 34 of the flexible grid 30 are spaced precisely and uniformly (e.g. by two inches) from one another, both longitudinally and transversely, except that, along the longitudinal and transverse edges of the flexible grid 30, each node 32 is spaced more closely (e.g. by one and one-half inches) from the nodes 32 nearest to said node 32.

Whether the flexible grid 30 conforms to the preferred construction or to the alternative construction, the flexible members 32 extending along the longitudinal and transverse edges of the concrete slab 20 reinforce the concrete slab 20 along the longitudinal and transverse edges of the concrete slab 20, so as to reinforce the outer edges of the concrete blocks 40 formed along the longitudinal and transverse edges of the articulated, predominantly concrete mat 50, when the concrete slab 20 is broken along the relatively thinner portions 22. Thus, the outer corners of those same blocks 40 are reinforced against cracking or to breaking.

Figure 5:
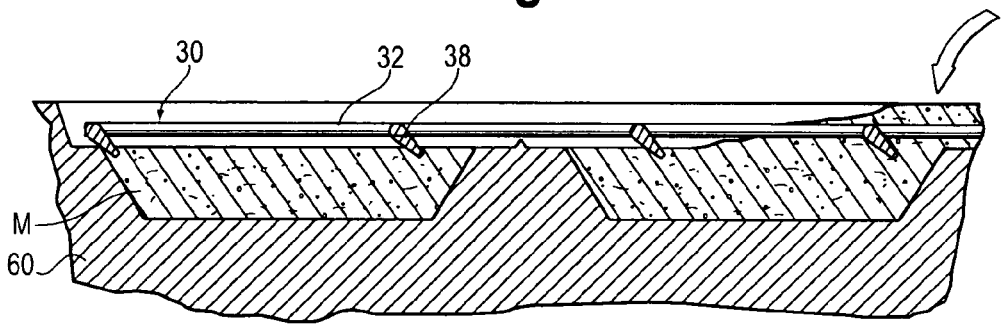
FIG. 5, on a larger scale, is a fragmentary cross-section of a casting mold, in which the concrete slab is being cast in an inverted orientation, as seen after an upper portion of the casting mold has been raised, a lower portion of the casting mold has been filled partially with a concrete mix, the flexible grid has been placed on the concrete mix, and a part of the lower portion (at the right of FIG. 5) has been completely filled with the concrete mix so as to embed the flexible grid.
Figure 6:
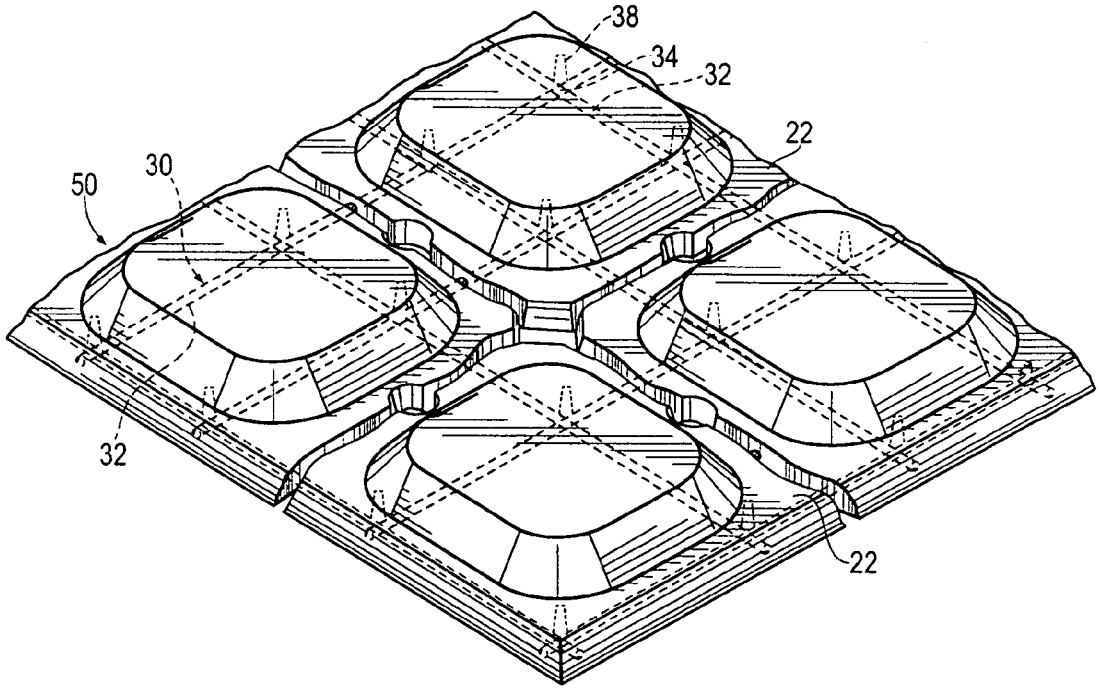
FIG. 6, on a similar scale, is a fragmentary, isometric view of an articulated, predominantly concrete mat, as made from the concrete slab having the embedded grid, when the concrete slab having the embedded grid is broken along thin areas so as to define concrete blocks, which are connected to one another by the flexible members of the flexible grid.

As illustrated in FIGS. 5 and 6, when the concrete slab 20 is cast in a casting mold 60, which has a lower portion and an upper portion, the lower portion of the casting mold 60 is filled partially with a concrete mix M, onto which the flexible grid 30 is placed. Thereupon, the lower portion 60 is filled completely with the concrete mix M, whereby the flexible grid 30 is embedded in the concrete mix M. Thereupon, the upper portion is lowered so as to close the casting mold 60, in which the concrete mix M is cured.

When the lower portion of the casting mold 60 is being filled completely with the concrete mix M, after the flexible grid 30 is placed onto the concrete mix M filling the lower portion of the casting mold 60 partially, the flexible grid 30 tends to float atop the concrete mix M. So as to restrain the flexible grid 30 against floating atop the concrete mix M, the flexible grid 30 is molded so as to have unitary fingers 38, which project downwardly from the nodes 34 into the concrete mix M. When the flexible grid 30 is disposed so that its longitudinally and transversely extending members 32 are disposed in an imaginary plane, the fingers 38 extend from and are normal to the imaginary plane.

Because the flexible grid 30 is injection molded, it can be precisely sized, its members 32 can be precisely spaced, as discussed above, and it can be unitarily formed with the fingers 38 projecting from the nodes 34.

The invention claimed is:

1. A flexible grid adapted to be embedded in a concrete article having relatively thicker portions connected by relatively thinner portions, said grid having two longitudinal edges and two transverse edges, the flexible grid having longitudinally extending members and transversely extending members, the longitudinally extending and transversely extending members meeting at nodes, which are spaced precisely and uniformly from one another, both longitudinally and transversely, except that, along the longitudinal and transverse edges, each node is spaced differently from the nodes nearest to said node, wherein said uniform spacing of said nodes not along said edges allows substantially all of said nodes not along said edges to be located in said relatively thicker portions of said concrete slab, and said different spacing of said nodes along said edges allows said nodes to be located in said relatively thinner portions surrounding said concrete article.

2. The grid of claim 1, wherein, along the longitudinal and transverse edges, each node is spaced more distantly from the nodes nearest to said node.

3. The grid of claim 1, wherein, when the longitudinal and transverse members are disposed in an imaginary plane and the flexible grid is not stressed, additional members of the flexible grid extend from the imaginary plane.

4. A predominantly concrete article comprising a concrete slab having relatively thicker portions and relatively thinner portions, the relatively thicker portions defining blocks connected by the relatively thinner portions, along which the concrete slab is breakable, wherein a flexible grid according to claim 1 is embedded in the concrete slab and wherein the longitudinally and transversely extending members of the flexible grid connect the blocks to one another when the concrete slab is broken along the relatively thinner portions.

5. The predominantly concrete article of claim 4, wherein holes in the relatively thinner portions define weakened areas, at which the concrete slab is breakable.

6. A predominantly concrete article comprising:

a concrete slab having two longitudinal edges and two transverse edges, relatively thicker portions defining uniformly shaped blocks, relatively thinner portions connecting said blocks, and relatively thinner portions extending about said edges of said slab, wherein said slab is breakable along said relatively thinner portions; and a flexible grid embedded in said concrete slab having interior longitudinally extending members and interior transversely extending members, two longitudinally extending members defining longitudinal edges of said grid, two transversely extending members defining transverse edges of said grid, said members being connected at nodes wherein the nodes between said interior members are positioned in said blocks, and said nodes along said edge members are positioned in said relatively thinner portions extending about said edges of said slab.

7. The predominantly concrete article of claim 6, wherein said blocks are connected in a substantially uniform pattern;

said nodes between said interior members are substantially uniformly spaced by a selected distance; and said nodes along said edge members are spaced from said nodes between said interior members by a distance different than said selected distance.

8. The predominantly concrete article of claim 7, wherein the spacing between said nodes along said edge members and said nodes between said interior members is greater than said selected distance.

9. The predominantly concrete article of claim 7, wherein the spacing between said nodes along said edge members and said nodes between said interior members is less than said selected distance.

10. The predominantly concrete article of claim 6, wherein said flexible grid lies substantially in a plane, and further comprising additional members of said flexible grid extending from said plane.

11. The predominantly concrete article of claim 6, wherein said flexible grid lies substantially in a plane, and further comprising additional members unitary with said flexible grid, said unitary members extending in directions intersecting said plane.

12. The predominantly concrete article of claim 6, wherein said selected distance is greater than the distance between adjacent blocks.

* * * * *